US007269379B2

(12) United States Patent
Nakanishi

(10) Patent No.: US 7,269,379 B2
(45) Date of Patent: Sep. 11, 2007

(54) IMAGE FORMING APPARATUS

(75) Inventor: Takashi Nakanishi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/268,458

(22) Filed: Nov. 8, 2005

(65) Prior Publication Data

US 2006/0104661 A1 May 18, 2006

(30) Foreign Application Priority Data

Nov. 12, 2004 (JP) ..... 2004-329240

(51) Int. Cl.
*G03G 15/16* (2006.01)

(52) U.S. Cl. ..... 399/122; 399/124; 399/125

(58) Field of Classification Search ..... 399/122, 399/124, 110
See application file for complete search history.

(56) References Cited

U.S. PATENT DOCUMENTS

| | | | | |
|---|---|---|---|---|
| 5,105,228 | A * | 4/1992 | Kato | 399/122 |
| 5,797,069 | A | 8/1998 | Kimura et al. | 399/113 |
| 5,887,228 | A * | 3/1999 | Motohashi et al. | 399/111 |
| 5,991,570 | A | 11/1999 | Haga et al. | 399/114 |
| 6,292,638 | B1 * | 9/2001 | Nagamine et al. | 399/122 |
| 6,314,256 | B1 * | 11/2001 | Saitoh | 399/122 |
| 2004/0208670 | A1 * | 10/2004 | Abe | 399/110 |
| 2006/0002737 | A1 * | 1/2006 | Shinshi | 399/122 |

FOREIGN PATENT DOCUMENTS

| | | |
|---|---|---|
| JP | 2-865893 | 12/1998 |
| JP | 2001-242680 | 9/2001 |
| JP | 2003-202728 | 7/2003 |
| JP | 2004-85899 | 3/2004 |

* cited by examiner

*Primary Examiner*—David M. Gray
*Assistant Examiner*—Ruth N. LaBombard
(74) *Attorney, Agent, or Firm*—Fitzpatrick, Cella, Harper & Scinto

(57) ABSTRACT

An image forming apparatus includes a fixing unit to fix an image formed on a recording material, first open-close means capable of releasing a conveying path to convey the recording material to the fixing unit, and second open-close means releasable upward in a vertical direction together with the intermediate transferring member, and when the first open-close member and the second open-close member are opened, the fixing unit is disposed on the image forming apparatus main body. In this manner, the effect of the weight of the fixing means can be reduced at the opening and closing time of any of the open-close means.

7 Claims, 7 Drawing Sheets

IMAGE FORMING APPARATUS

BACKGROUND OF THE INVENTION

1. Field of the Invention

The present invention relates to an image forming apparatus such as a full color copying machine, a printer and the like adopting an electrophotographic system.

2. Related Background Art

In recent years, in general, as a plural color or full color image forming apparatus using an electrophotographic system, as shown in FIGS. 7A and 7B, an in-line type of the image forming apparatus has been disclosed in Japanese Patent Application Laid-Open No. 2001-242680, Japanese Patent Application Laid-Open No. 2003-202728, and Japanese Patent Application Laid-Open No. 2004-85899, in which a photosensitive member drum 1000 is lined up in a plurality according to each color, and the toner image of each color formed on each photosensitive member drum 1000 is superposed in order on an intermediate transferring belt 1010 to form a color image, and after the secondary transfer of the toner image on a sheet (recording material) to be conveyed, the toner image is heat-fixed by fixing means 1050, and is discharged into a discharge tray 1020. These constitutions, in which an exposing apparatus is disposed at the underside, can shorten a moving distance from the intermediate transferring member until the toner image is transferred on the recording member, and are effective in reduction of a first copy time.

In such image forming apparatus, in the image forming apparatus having the above described constitution, to remove a sheet jammed (sheet cogging) in a sheet conveying path, a unit retaining the sheet conveying path is rotatably constituted as a front door unit 1040, and the sheet conveying path from a cassette to the fixing apparatus device is made releasable.

On the other hand, since the intermediate transferring belt 1010 has also frequent entangling of the recording material occurred to it, it is desirable to open the intermediate transferring belt 1010. Particularly, in Japanese Patent No. 02865893, it is disclosed, an apparatus having a door to release the conveying path and a door to exchange an image forming unit. It, however, is difficult to remove the recording material from the intermediate transferring member effectively since the intermediate transferring member is not sufficiently opened.

To cope with this situation, as shown in Japanese Patent Application Laid-Open No. 2004-85899 as shown in FIG. 7B, to easily process the entangling of the sheet to the intermediate transferring belt 1010, an upper door unit 1030 having a discharge tray 1020 and the intermediate transferring belt 1010 is rotatably constituted for the image forming apparatus. As a result, because of the opening of the front door unit 1040, it is easy to access the conveying path, and by pivoting the upper door unit 1030 toward above the main body (in the direction to an arrow C in FIG. 7), an access to the intermediate transferring belt 1010 is made easy. As a result, jam processing of the conveying path of the sheet can be improved.

However, in the constitution where an open-close member to open the conveying path and an open-close member to open the intermediate transferring member are provided respectively in this manner, if fixing means is attached to either of the open-close members, there arises a following problem. That is, if the fixing means is attached to the open-close member capable of opening and closing upward in the vertical direction, there arise a problem of a lack of stability at the releasing time due to the weight of the fixing means, and also a problem of the constitution becoming complicated due to the necessity of enhancing rigidity of an open-close cover so as to be similarly endurable with the weight of the fixing means when the fixing means is attached to the open-close cover of the side surface.

SUMMARY OF THE INVENTION

An object of the prevent invention is to reduce a heavy load of a fixing device when releasing a conveying path and an intermediate transferring member by an open-close member.

Another object of the present invention is to provide an image forming apparatus comprising: image forming means having an image bearing member; an intermediate transferring member disposed above the image forming means and transferred with a toner image formed by the image forming means; an fixing unit fixing the toner image transferred on a recording material from the intermediate transferring member by heat; a recording material conveying path to convey the recording material toward the fixing unit through a transferring portion to transfer the toner image of the intermediate transferring member on the recording material; first open-close means releasing the recording material conveying path; second open-close means moving integrally with the intermediate transferring member and exposing the intermediate transferring member; and an image forming apparatus main body supporting at least the fixing unit, the first open-close means, and the second open-close means, wherein when the first open-close means and the second open-close means are in an open state, the fixing unit is supported by the image forming apparatus main body.

A further object of the present invention will become apparent from the following description.

DETAILED DESCRIPTION OF THE PREFERRED EMBODIMENT

The present invention will be described below more specifically by citing the embodiments. Although these embodiments are an example of the preferred embodiments in the present invention, the present invention is not limited by these embodiments.

First Embodiment

An embodiment will be shown in FIGS. 1 to 6. A printer is an image forming apparatus having four colors of yellow (Y), magenta (M), cyan (C), and black (BK).

<General Structure of Image Forming Apparatus>

Figure 1:
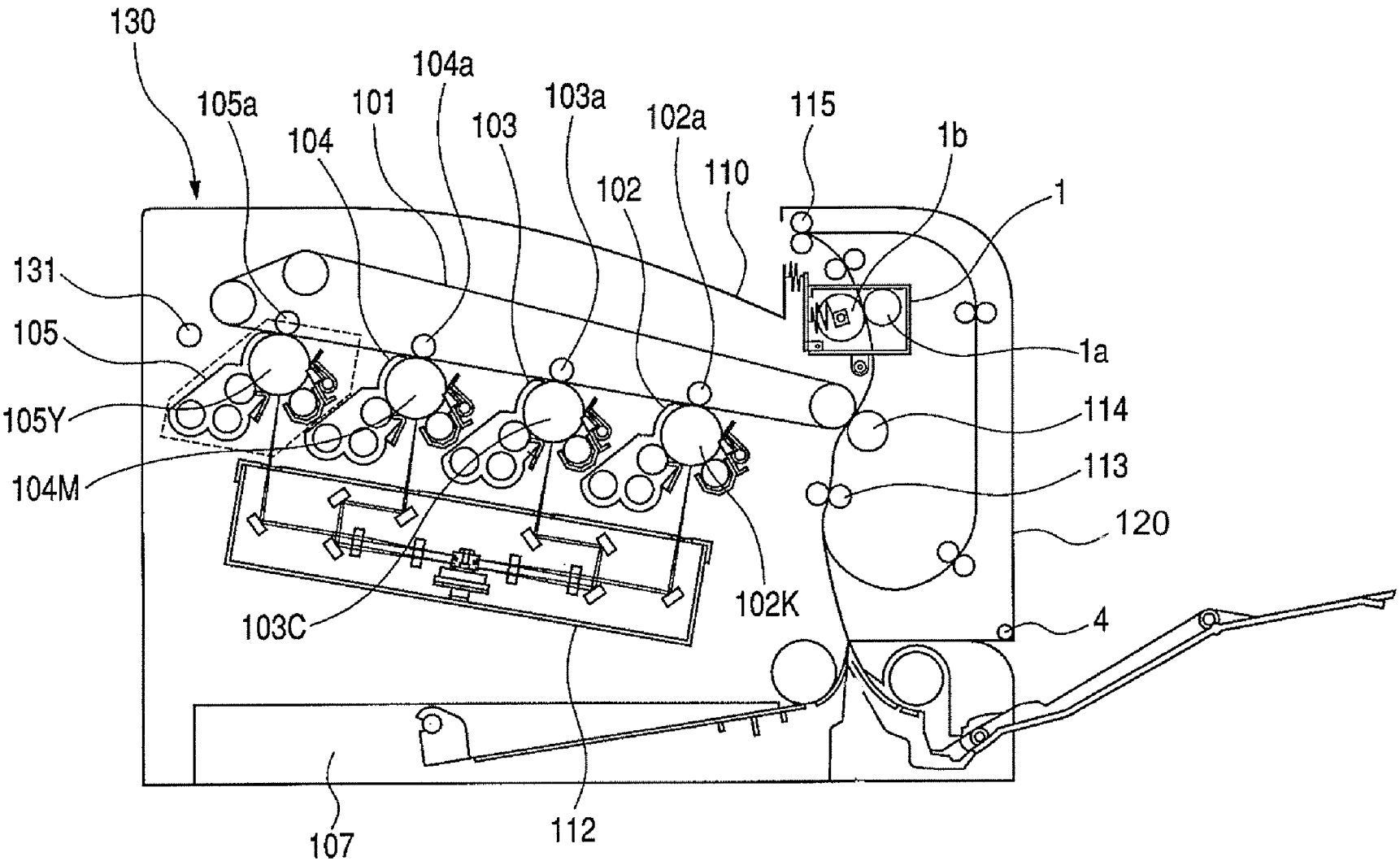
FIG. 1 is a cross sectional view of an image forming apparatus of the present invention.

First, the general structure of the image forming apparatus will be described with reference to FIG. 1. FIG. 1 is a cross sectional schematic explanatory view of the image forming apparatus.

The image forming apparatus shown in FIG. 1 is disposed with four pieces of photosensitive member drums (105Y, 104M, 103C, and 102K) which are image bearing members to form toner images of each color of yellow (Y), magenta (M), cyan (C), and black (K). The periphery of each photosensitive member drum is disposed with a charging device to charge each photosensitive member drum, a developing device to develop an electrostatic latent image formed by exposure, and a cleaning member to clean the toner on the photosensitive member drum after transferring, and these are unitized as process cartridges (105, 104, 103, and 102) which are image forming units. On top of these process cartridges, the intermediate transferring belt 101 is disposed as an example of a belt member which is the intermediate transfer member in such a manner as to contact each photosensitive member drum.

Further, below the process cartridge, there is provided an exposure means 112 to irradiate laser toward each photosensitive member drum according to an image signal and perform a selective exposure.

Each photosensitive member drum is charged by the charging device, and a light image of each color of color separated yellow, magenta, cyan, and black is exposed by the exposing means 112, so that the electrostatic latent images of yellow, magenta, cyan, and black are formed on the photosensitive member drum. Each electrostatic latent image is developed by the developing device, and the toner images of yellow, magenta, cyan and black are formed on the photosensitive member drum.

Accompanied with the rotation of the photosensitive member drum, the toner image reaches a primary transferring region where the photosensitive member drum and the intermediate transferring belt 101 are abutted against each other. This toner image is transfeffed in order to the intermediate transferring belt 101 by a primary transferring roller (102*a*, 103*a*, 104*a*, and 105*a*) which is a primary transferring member disposed in opposition to each photosensitive member drum (105*y*, 104*m*, 103*c*, 102*k*). The primary transferring roller (102*a*, 103*a*, 104*a*, 105*a*) is applied with a primary transferring bias set in advance from an electrical substrate.

The recording material stored in a sheet feeding cassette 107 loaded at the bottom of the apparatus main body is fed from a feeding roller one by one in synchronization with the image formation, and after exactly timed by a registration roller 113, the sheet is conveyed to a secondary transferring portion. In the secondary transferring portion, a secondary transferring roller 114 as secondary transferring means is rotated according to drive by contacting the intermediate transferring belt 101. When the sheet is conveyed to this secondary transferring portion, the secondary transferring roller 114 is applied with a bias, so that the toner image on the intermediate transferring belt 101 is collectively secondary-transferred on the sheet.

After that, the sheet transferred with the toner image is conveyed to a fixing unit 1 which is the fixing means constituted by a fixing roller 1*a* which is an image heating member and a pressure roller 1*b* which is a pressure member, and there, with heat and pressure received, the toner image on the recording material is fixed. In this manner, the toner of each color is melted and mixed and fixed on a sheet, and is turned into a print image of a full color, and after that, is discharged into a discharge tray 110 which is a recording material mounting portion by a discharge roller pair 115 provided in the down stream of the fixing unit.

The image forming apparatus according to the present embodiment having the above described constitution is provided, from below to upward of the apparatus main body, with a sheet feeding cassette 107, exposing means 112, process cartridges (102, 103, 104, and 105), an intermediate transferring belt 101, and a discharge tray 110 in that order. Hence, the sheet conveying route, which is a conveying path, is formed in such a manner as to convey the sheet from below to upward.

Further, within the apparatus main body, there are disposed a fixed power supply and a main electrical substrate to perform control of the entire image forming apparatus. This electrical substrate can be disposed in a space formed between the exposing means 112 and the sheet conveying cassette 107.

Further, the surface connecting the primary transferring portion which is an opposing portion with four pieces of the photosensitive member drum 1 and the intermediate transferring belt 101 is constituted in such a manner as to be inclined so as to have the secondary transferring portion side below. In the present embodiment, since the angle of inclination is set to approx. 15°, following this angle, each process cartridge and the exposing means 112 are also inclined at the same angle and disposed.

In the image forming apparatus of the present embodiment, the right side of FIG. 1 is the front side of the apparatus, and a user performs various operations from the front side of the apparatus.

<Open-Close Portion>

Next, an open-close portion which is openable and closable for the apparatus main body will be described.

Figure 3:
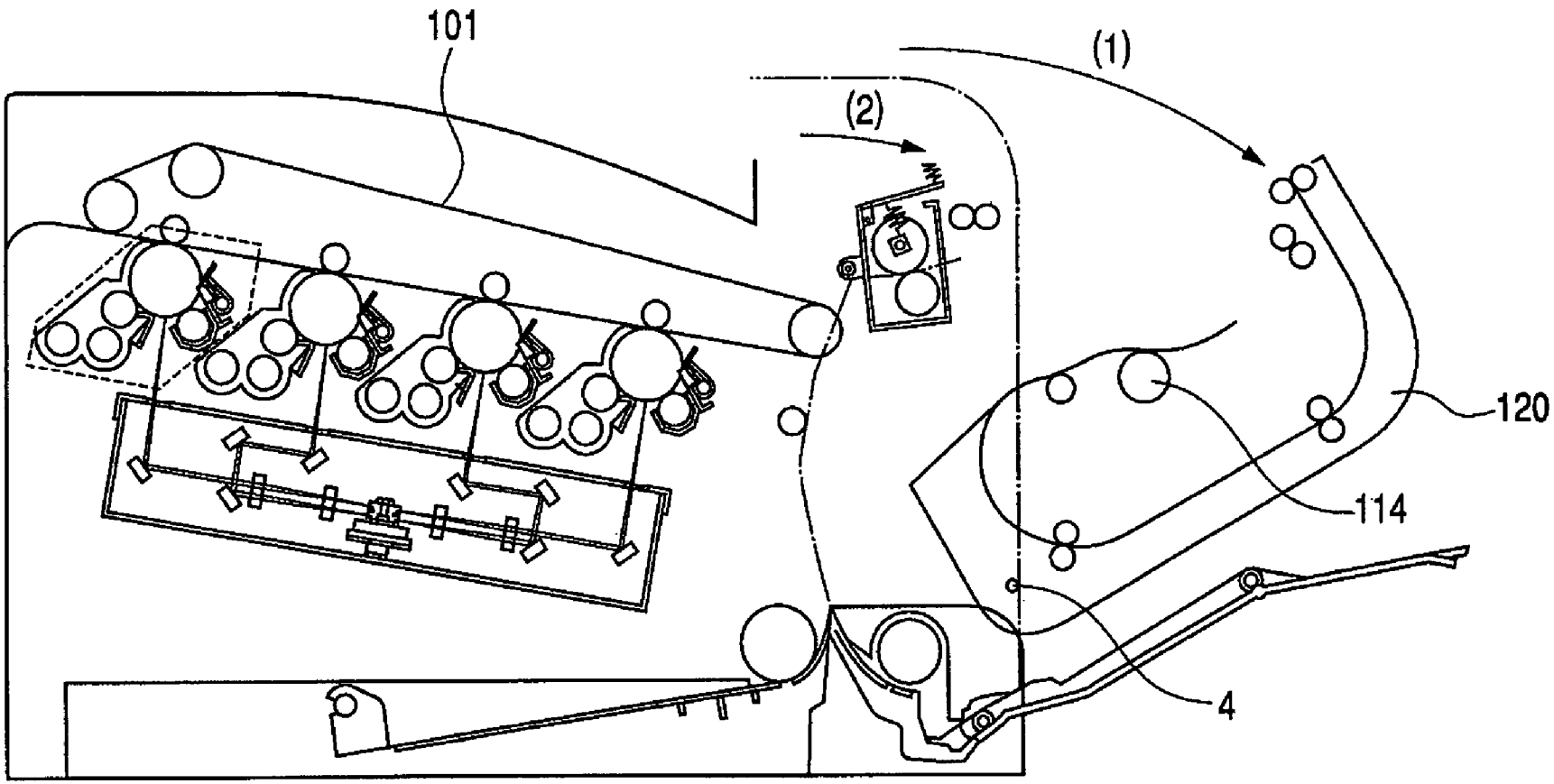
FIG. 3 is a cross-sectional view of the present invention during jam processing.

The image forming apparatus of the present embodiment, as shown in FIG. 3, has a front door unit 120 as first open-close means disposed in the front side of the apparatus main body. This front door unit 120 is also pivotable for the apparatus main body with a support shaft 4 as a center, and by pivoting, the main body front side becomes openable and closable.

The front door unit 120 is disposed with a secondary transferring roller 114, and as shown in FIG. 3, when the front door unit 120 is opened, a sheet conveying route is exposed, and a jammed sheet can be easily removed. Further, the support shaft 4 is disposed at the bottom of the apparatus main body, and when the upper portion of the front door unit 120 is pivoted and opened, the sheet conveying path is widely opened.

Figure 6:
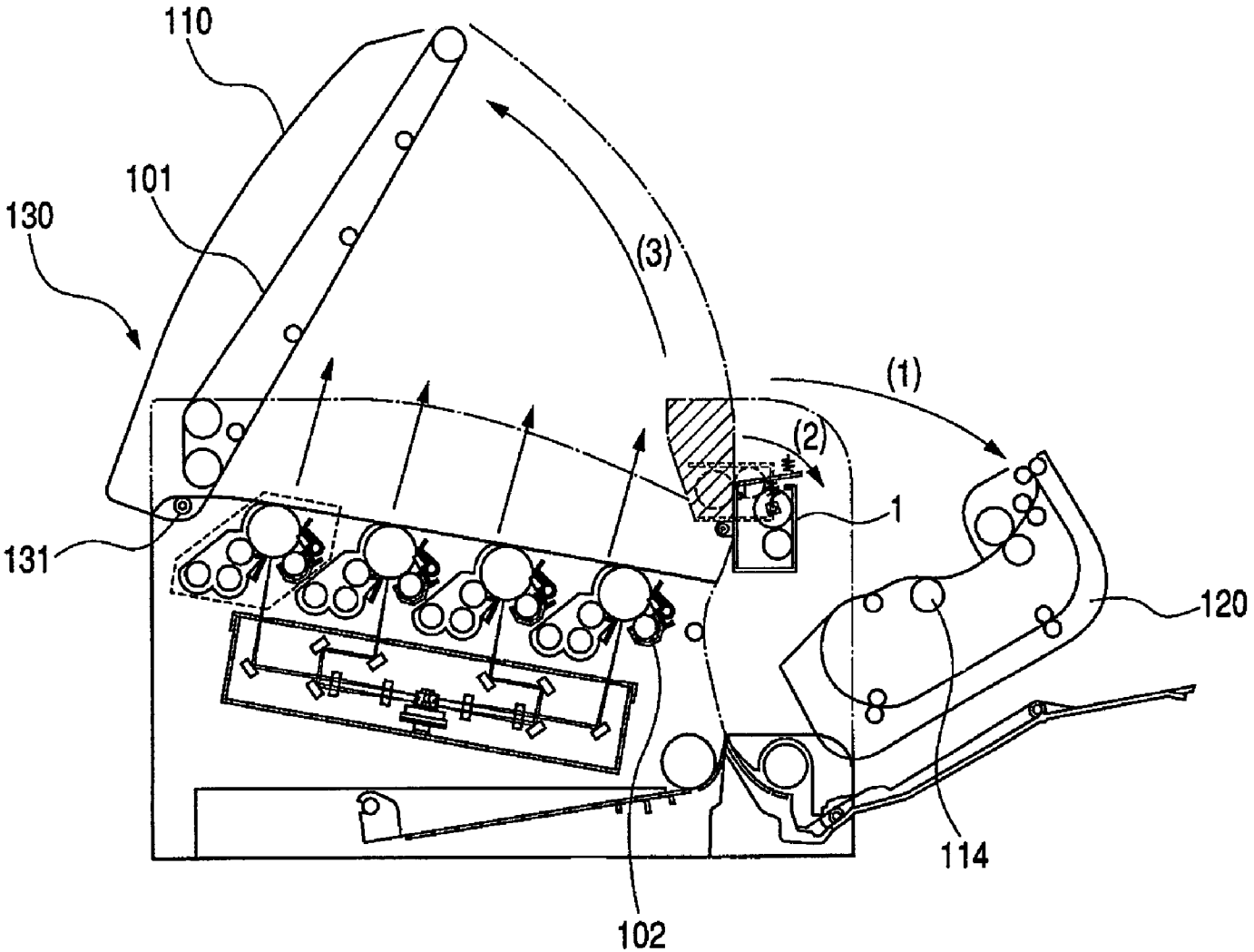
FIG. 6 is an embodiment view of the present invention.
Figure 7A:
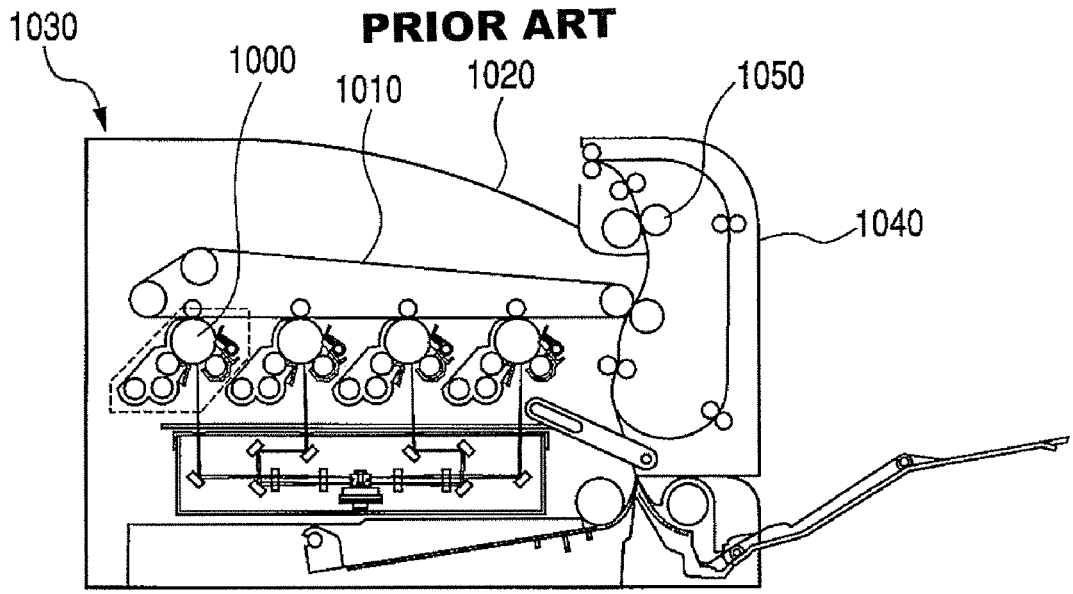
FIG. 7A PRIOR ART
FIGS. 7A and 7B are views of the conventional image forming apparatuses.
Figure 7B:
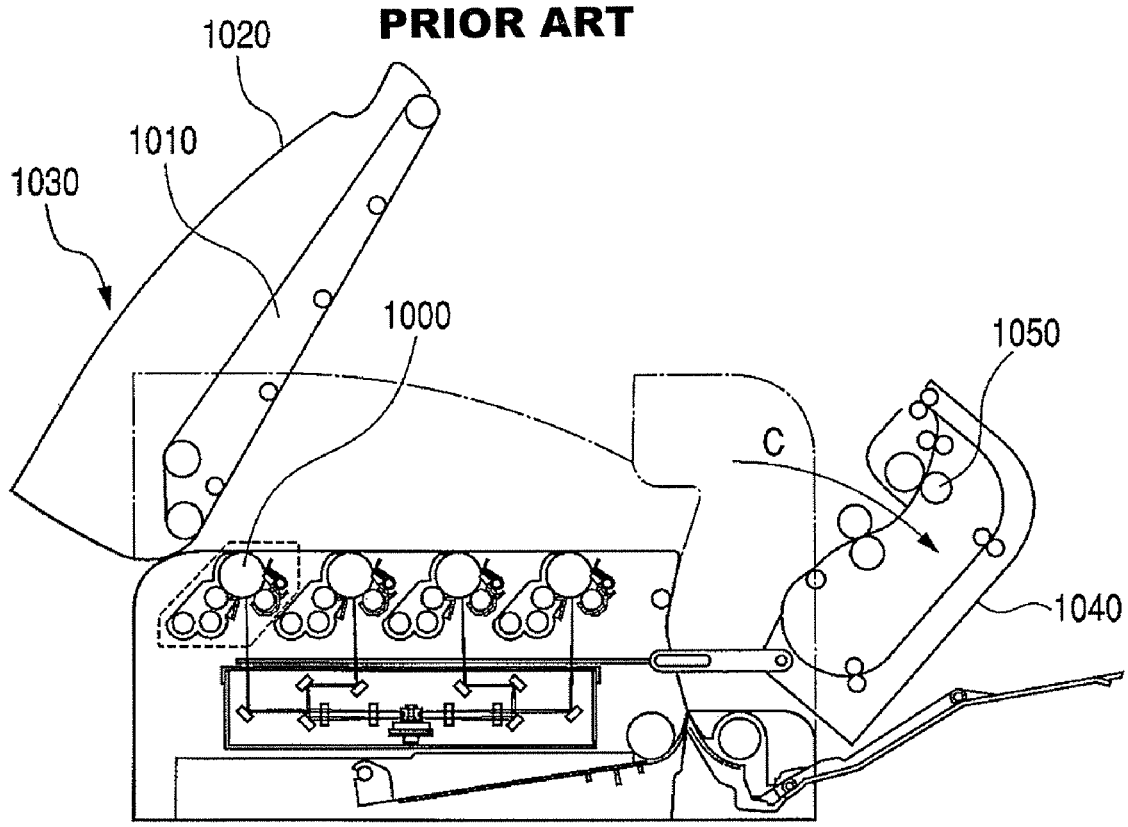
FIG. 7B PRIOR ART

Next, reference is made to FIG. 6. The upper portion of the apparatus main body is disposed with an upper door unit 130 as second open-close means. This upper door unit 130 is pivotable for the apparatus main body with a support shaft 131 as a center, and by pivoting, the upper portion of the apparatus main body becomes openable and closable.

The upper door unit 130 includes an intermediate transferring-unit having unitized the intermediate transferring belt 101. Hence, as shown in FIG. 6, when the upper door unit 130 is opened, the process cartridge including the photosensitive member drum are exposed, and the exchange (detachment and attachment) of the process cartridge can be performed by a guide portion for detachment and attachment of the process cartridge. Further, since the intermediate transferring belt 101 disposed on the upper door unit 130 is also exposed, the exchange thereof can be easily performed. Here, in the image forming apparatus of the present embodiment, the upper door unit 130 is constituted in such a manner as to be openable only when the front door unit 120 is in an opened-state.

That is, as shown in FIG. 6, the upper door unit 130 is opened by pivoting upward with the support shaft 131 as a center. At this time, the upper portion of the front door unit 120 is constituted in such a manner as to protrude into the upper door unit 130 side.

Consequently, when an attempt is made to open the upper door unit 130 in a state in which the front door unit 120 is closed, the pivoting locus of the upper door unit 130 interferes with the front door unit 120. On the other hand, when the front door unit 120 is put into an opened state, the interference disappears, and the upper door unit 130 becomes operable.

In case the front door unit 120 is closed, in reverse to the case when it is opened, after the upper unit 130 is closed, then, the front door unit 120 is closed.

That is, the image forming apparatus of the present embodiment has the upper door unit 130 made openable and closable only when the front door unit 120 is in an opened state.

Further, as described above, the primary transferring surface can be incline-disposed, and an extra space arisen down below the bottom of the exposing means 112, which is a merit of the incline disposition, is stored with various electrical substrates which ought to have been actually provided in the depth direction or the width direction of the image forming apparatus, so that the volume of the total image forming apparatus can be reduced.

Next, a method of jam processing of the recording material in the present embodiment will be described. In the present embodiment, the recording material to be conveyed from a cassette is conveyed to a fixing unit 1 through a registration roller and the secondary transferring portion. On the other hand, the secondary transferring portion is constituted to abut against the intermediate transferring member. In such constitution, the recording material often causes a sheet clogging in the conveying route. In this case, by releasing the front door unit 120, the recording material in the midst of the conveying route can be removed. On the other hand, the recording material often moves in the direction of the intermediate transferring belt. In this case, by releasing the upper door unit 130, the intermediate transferring belt can be opened, and the jam processing of the recording material in the vicinity of the intermediate transferring belt can be easily performed.

In this manner, in the constitution where the conveying path is opened by one open-close means and the intermediate, transferring member is opened by another open-close means, there are the cases where each of them is opened according to the extent of the jam processing of the recording material. Hence, when the fixing unit is provided in either of these open-close means, the following problem arises. When the fixing unit is provided in the front door side, the weight of the front door becomes heavy, and therefore, it is necessary to increase the rigidity of the front door. On the contrary, when the fixing unit is provided in the upper door side, the load of releasing the upper door becomes not only heavy, but the rigidity of the upper door must be also similarly increased. Further, since the upper door is provided with the intermediate transferring belt, when the upper door is closed, the upper door is possibly closed energetically due to the weight of the fixing unit, and it is feared that a driving transmission system to transmit a driving to the intermediate transferring belt from the image forming main body is damaged.

To avoid such problem, the present invention is constituted such that the fixing unit is left over in the image forming apparatus regardless of whichever open-close means is in an open state.

<Pivoting of Fixing Unit>

The fixing unit 1 pivots by having a pivoting shaft 2 on the main body portion adjacent to the fixing unit 1, and has two positions. That is, the main unit is pivotable to a position which is fixable (a first position) when both of the upper door unit 130 and the front door unit 120 are closed, and to another position (a second position) when either of the upper door or the front door is opened. In this manner, by allowing the fixing unit 1 to be movable to another position, the efficiency of the processing operation at the time when the recording material is jammed in the fixing unit 1 can be enhanced. Further, at the exchange time of the fixing unit 1, it can be moved to the second position, so that the exchangeability can be enhanced.

The pivoting mechanism of this fixing unit will be described.

Figure 5:
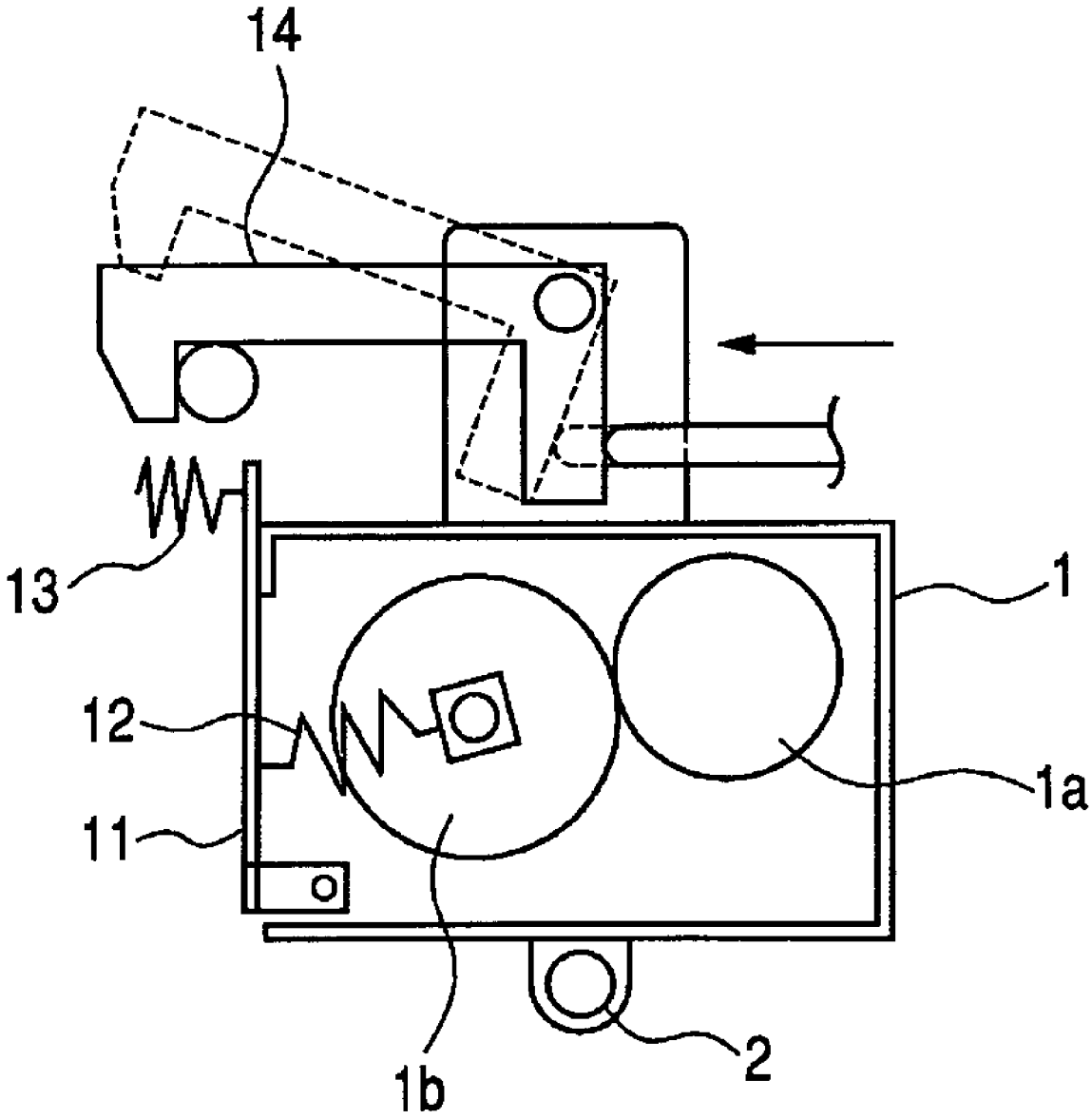
FIG. 5 is a conceptual illustration of a fixing device pressure releasing mechanism of the present invention.

As shown in FIG. 5, the fixing unit 1 comprises a lever 11 and a pressure application mechanism capable of releasing the pressure by springs 12 and 13, and can release and pressurize the pressure by the operation of the lever 11.

The front door unit 120, similarly to the fixing unit 1, has a pivoting center 4 in the main body, and performs closing and opening operations. The pivoting center 4 of the front door unit 120 is at a position below the front of the main body, which is different from the pivoting shaft 2 of the fixing device, and can occupy a wide open space.

The front door 120 has a hook, and hangs the hook at a different position in the thrust direction of the pivoting shaft 2 of the fixing unit 1 at the closing time of the front door, and decides a position of the setting time for the main body. By so doing, the position of the setting time for the fixing unit 1 of the front door unit 120 can be accurately decided. The front door releasing operation is performed by removing the hook from the pivoting shaft 2, so that the front door unit 120 can be opened. The fixing unit 1 has the lever 11 energized to the upper wall of the main body by the spring 12 in the first position, and pressurizes the fixing device by the spring 13.

As described above, the fixing device is retainable in the first position by a retaining member 14, and at this position, the performance of the fixing device is guaranteed (FIG. 5).

Figure 2:
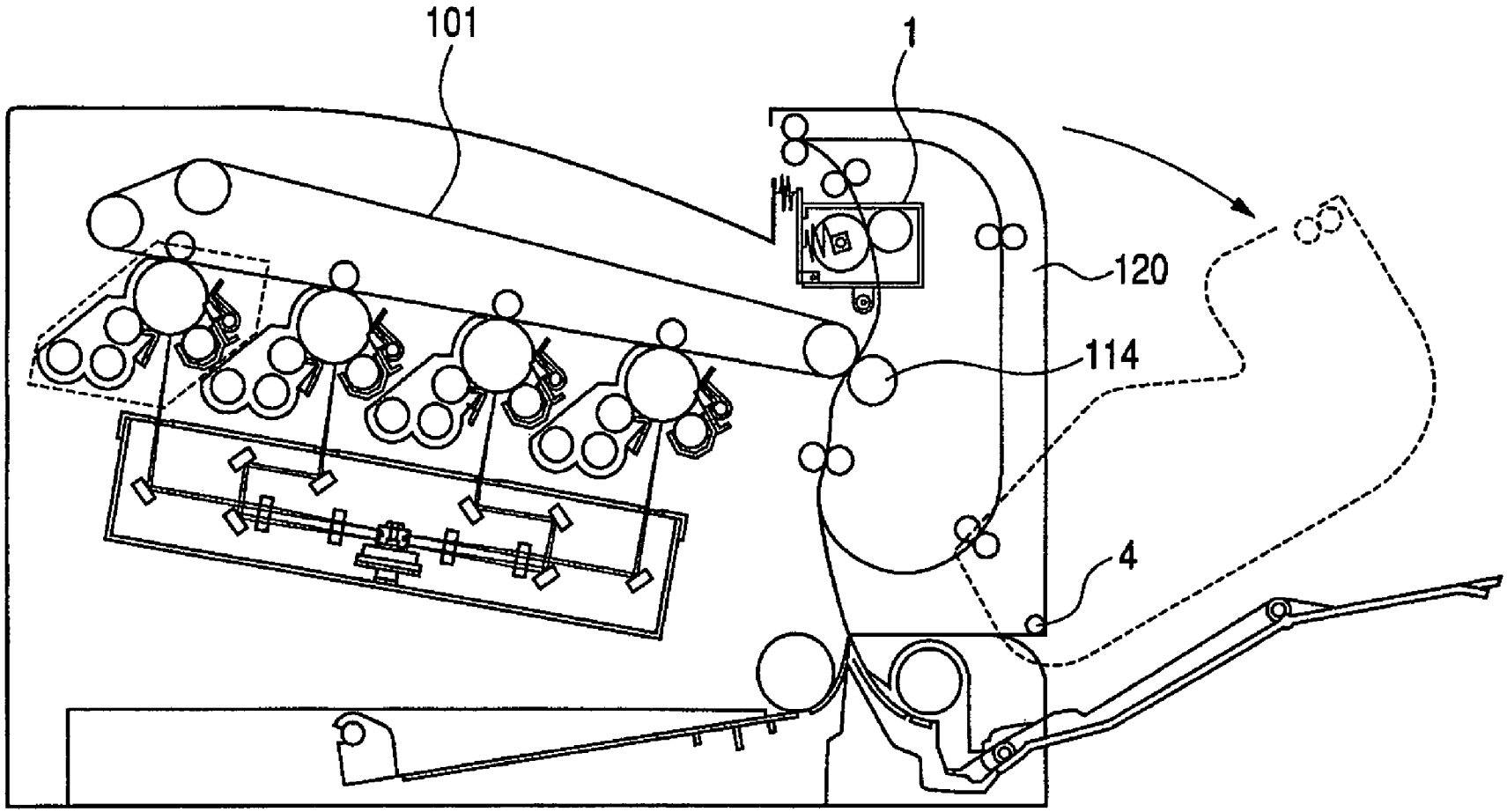
FIG. 2 is a cross-sectional view of FIG. 1 during jam processing in the present invention.
Figure 4:
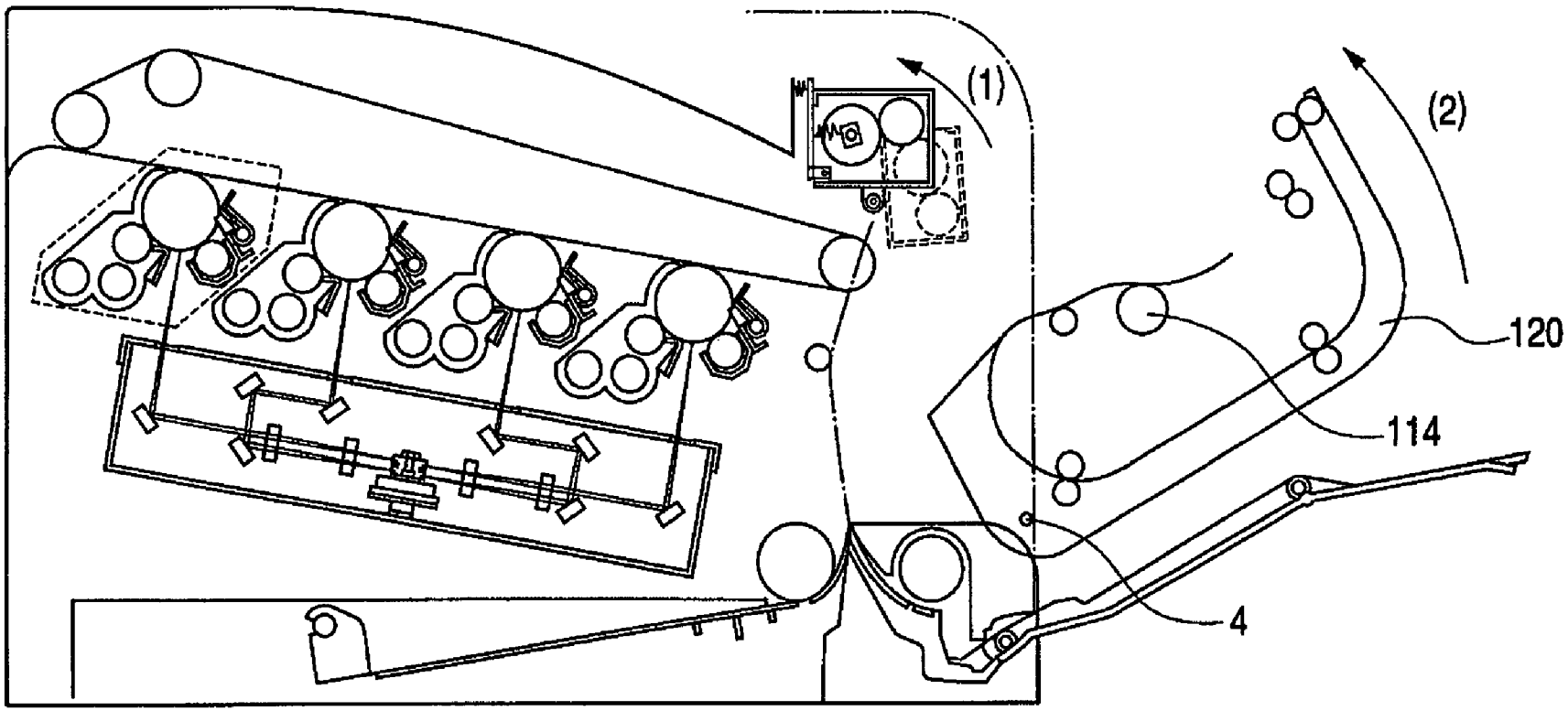
FIG. 4 is a return view after the jam processing of the present invention.

Next, in the second position, the lever 11 is opened so as to release the pressure (at the releasing time of the fixing device). As described above, in case a jam occurs at the print operation time, first, the user can be allowed to easily recognize a jammed sheet by opening the front door unit 120 when the jam sheet stays at the fixing device (FIG. 2). In association with the pivoting of the fixing device (to the second position), the nip is opened so as to allow the user to take out the sheet and process the jam processing (FIG. 3). After the jam processing, the fixing unit 1 is set (to the first position), and the front door unit 120 is closed (FIG. 4).

By the above operation, the jam processing is improved. That is, a necessary force to close the front door 120 can be reduced since the pivoting shaft 2 of the fixing unit 1 can be located to be closer than the pivoting center 4 of the front door unit 120 at the closing time.

Next, the exchange method of the unit will be described. First, the user can find out the exchange time of each unit by the message of the main body. The unit requiring the exchange is exchanged by the user.

In the present embodiment, the following exchange unit will be described. First, the taking out of the process cartridges 102 to 105 will be described.

To exchange the process cartridges 102 to 105 requiring the exchange, it is necessary to open the door of the upper door unit 130 which is located in a taking out direction from the main body. However, since the front door unit 120 and the fixing unit 1 stay on the pivoting locus of the upper door unit 130, if the units are left there intact, the door does not open. Hence, first, the front door unit 120 is pivoted and opened, and after that, the fixing unit 1 is moved to the second position. Then, the front door unit 120 and the fixing unit 1 are deviated from the pivoting locus of the upper door unit 130, and the upper door unit 130 can be opened (FIG. 6). Since the upper door unit 130 retains the intermediate transferring member 101, when the upper door unit 130 is opened, the intermediate transferring member 101 located above the process cartridges 102 to 105 is similarly released, whereby the process cartridges 102 to 105 come into view.

The position of the fixing unit 1, in view of the locus which is getting ahead of or distanced from the process cartridge 102 of the nearest side, is the second position. In this sate, the process cartridges 102 to 105 requiring the exchange are taken out along the guide portion for detachment and attachment in the direction of the arrow mark of FIG. 6, so that the process cartridges 102 to 105 can be taken out. After that, new process cartridges are provided, and the process cartridges 102 to 105 are put into each station designated for color.

In case the exchange of the intermediate transferring member 101 is required, with the upper door unit 130 put in an opened state, both the left and right buttons of the intermediate transferring unit of the intermediate transferring member 101 disposed at the bottom of the discharge tray are depressed, so that a lock of the intermediate transferring member 101 is opened from the upper door unit 130, and the intermediate transferring member 101 is disconnected by taking out the unit near side by the user.

The fixing unit 1 can be exchanged from the main body by disconnecting the lever in the second position with the lever retaining the pivoting shaft 2 disconnected.

The new process cartridges 102 to 105, the intermediate transferring member 101, the fixing unit 1 are set up in a reverse procedure to disconnect, and the sheet discharge tray 110, the fixing unit 1, and the front door unit 120 are closed, thereby completing the exchange operation.

By the above described operation, despite of being a small machine, the user can easily exchange the unit of each expendable item by this machine.

In the present embodiment, though the sheet discharge tray has been installed in the upper door unit 130, naturally there is no problem even if the sheet discharge tray is separately installed.

Further, in the present embodiment, though a description has been made on a printer not mounted with a copy image reading apparatus to read a copy image, there is no problem even if the embodiment is constituted to be mounted with the copy image reading apparatus.

Although a constitution is conceivable where an image heating apparatus to heat the image on the recording material is provided in addition to the fixing unit 1, since this image heating apparatus is relatively lighter in weight than the fixing unit 1, even if it is attached to each open-close portion, the load on the open-close portion does not become large. Naturally, there is not problem even if it is constituted to be attached to image forming apparatus main body.

By the present invention, an access to the conveying route and the intermediate transferring member is made easy due to releasing of the open-close member without being affected by the weight of the fixing unit 1.

While the embodiment of present invention has been described as above, it is to be understood that the present invention is not limited to the above described embodiment under any circumstance and any variations will occur to those skilled in the art within the scope of the present invention.

This application claims priority from Japanese Patent Application No. 2004-329240 filed on Nov. 12, 2004, which is hereby incorporated by reference herein.

What is claimed is:

1. An image forming apparatus, comprising:

image forming means having an image bearing member;

an intermediate transferring member disposed above said image forming means and transferred with a toner image formed by the image forming means;

a fixing unit fixing the toner image transferred on a recording material from the intermediate transferring member;

a recording material conveying path to convey the recording material toward the fixing unit through a transferring portion to transfer the toner image of the intermediate transferring member on the recording material;

first open-close means disposed at the side surface of the image forming apparatus, said first open-close means being openable independently of said fixing unit so that said recording material conveying path is opened; and second open-close means disposed on the upper surface of the image forming apparatus, said second open-close means supporting the intermediate transferring member and being openable independently of said fixing unit.

2. The image forming apparatus according to claim 1, wherein the intermediate transferring member is supported by the second open-close means.

3. The image forming apparatus according to claim 1, wherein the fixing unit is supported by a main body of said forming apparatus having an image forming means.

4. The image forming apparatus according to claim 1, wherein when at least one of said first open-close means is opened, the fixing unit is effected being pivotable.

5. The image forming apparatus according to claim 3, wherein when said first open-close means is opened, the fixing unit is effected being pivotable.

6. The image forming apparatus according to claim 1, wherein the fixing unit comprises a heating member to heat the toner image on the recording material and a pressure member to pressure a heating member and nip and convey the recording material, and in association with the pivoting of the fixing unit, the pressure of the heating member and the pressure member is reduced.

7. The image forming apparatus according to claim 1, wherein the image forming means is plural image forming units, and the image forming unit is detachably attachable from a releasing portion by the second open-close means.

* * * * *

UNITED STATES PATENT AND TRADEMARK OFFICE

CERTIFICATE OF CORRECTION

PATENT NO. : 7,269,379 B2
APPLICATION NO. : 11/268458
DATED : September 11, 2007
INVENTOR(S) : Takashi Nakanishi It is certified that error appears in the above-identified patent and that said Letters Patent is hereby corrected as shown below:

COLUMN 2:
Line 19, “an” should read --a--.

COLUMN 3:
Line 39, “transfeffed” should read --transferred--.

COLUMN 4:
Line 58, “ferring-unit” should read --ferring unit--.

COLUMN 5:
Line 3, “opened-state.” should read --opened state.--.
Line 50, “diate,” should read --diate--.

COLUMN 8:
Line 2, “not” should read --not a--.

Signed and Sealed this

Twenty-fourth Day of June, 2008

JON W. DUDAS
*Director of the United States Patent and Trademark Office*